US006704936B1

(12) United States Patent
Carlin

(10) Patent No.: US 6,704,936 B1
(45) Date of Patent: Mar. 16, 2004

(54) BOXING GLOVES INCORPORATING MULTI-LAYER, ANTI-ABSORBENT MATERIALS

(75) Inventor: Mitch Carlin, Boca Raton, FL (US)

(73) Assignee: Technical Knockout, Inc., Pompano Beach, FL (US)

( * ) Notice: Subject to any disclaimer, the term of this patent is extended or adjusted under 35 U.S.C. 154(b) by 32 days.

(21) Appl. No.: 10/051,467

(22) Filed: Jan. 18, 2002

(51) Int. Cl.[7] ..... A41D 13/08
(52) U.S. Cl. ..... 2/18; 2/161.1
(58) Field of Search ..... 2/16, 18, 20, 158, 2/159, 160, 161.1, 161.6, 162, 163, 164

(56) References Cited

U.S. PATENT DOCUMENTS

| | | | | |
|---|---|---|---|---|
| 4,295,228 A | | 10/1981 | Dragomir | |
| 4,424,595 A | | 1/1984 | Albert | |
| D273,343 S | | 4/1984 | Albert | |
| 4,530,873 A | * | 7/1985 | Okada | 442/79 |
| 4,603,439 A | | 8/1986 | Golomb | |
| 5,043,209 A | * | 8/1991 | Boisse et al. | 442/397 |
| 5,083,314 A | * | 1/1992 | Andujar | 2/18 |
| 5,232,427 A | | 8/1993 | Paro | |
| 5,390,372 A | | 2/1995 | Hashimoto | |
| 5,502,841 A | | 4/1996 | Stanford | |
| 5,774,895 A | | 7/1998 | Baldwin | |
| 5,946,720 A | * | 9/1999 | Sauriol | 2/16 |
| 6,154,886 A | | 12/2000 | Hottner | |
| 6,178,553 B1 | * | 1/2001 | Bolton | 2/18 |
| 6,202,213 B1 | | 3/2001 | Georgick | |

* cited by examiner

*Primary Examiner*—Gary L. Welch
(74) *Attorney, Agent, or Firm*—Malin, Haley & DiMaggio, P.A.

(57) ABSTRACT

A Boxing glove having an inner mitt into which a boxer's hand is placed. The inner mitt utilizes a two layer palm lining which forms the front of the mitt and opposes a waterproof Taffeta pad lining which forms the back of the mitt. The inner mitt is attached to a padded outside covering and cuff so that the palm lining is exposed to the outside. The inner mitt is arranged so that in use as the boxer's hand perspires the first layer of the palm lining wicks away the sweat and the second layer allows it to dry and escape to the outside. Additionally, the waterproof Taffeta lining does not allow sweat to be absorbed by the boxing glove so that it maintains it's intended weight. The inner mitt incorporates grip bars and reinforced sections.

11 Claims, 3 Drawing Sheets

BOXING GLOVES INCORPORATING MULTI-LAYER, ANTI-ABSORBENT MATERIALS

BACKGROUND OF THE INVENTION

1. Field of the Invention

The present invention relates to boxing gloves and more specifically to boxing gloves which incorporate breathable mesh and absorbent linings.

2. Description of Related Art

Boxing gloves are used in amateur and professional boxing matches and for training purposes. Boxing gloves are conventionally shaped to accommodate a user's fist and are formed by an inner mitt into which the user inserts their hand and an outer shell which is padded. The thickness of the padding is increased or decreased depending upon the application.

The padding is intended to provide a protective cushion to prevent damage to the user's hand as well as the target which is being struck, such as a heavy bag or opponent. The amount and type of padding used depends on the application. Typically, training gloves incorporate only a small portion of padding in order to protect the users hands. Conversely, sparing gloves utilize a thicker amount of padding to protect not only the users hands but also the sparring partner from damage. The padding in boxing gloves is typically formed by polyfoam, polyvinyl chloride closed cell and open cell layers. The outer shell of the glove is conventionally covered by leather, vinyl or other durable material and the inner mitt is cotton or other durable material.

While the padding within the gloves serves to protect the user from potential damage from impact, the user must properly form a fist with their hands within the gloves or risk injury to their hands including broken bones and sprained joints within the hand. Additionally, forming and maintaining a proper fist reduces the potential for eye injuries where the sparing partner or opponent is struck by an extended thumb. Eye injuries during boxing are a serious problem given the potential for permanent injury and extreme discomfort.

In use the user inserts their hands within the inner mitts of the gloves. Conventional boxing gloves are typically secured around the users hands by laces which are threaded through eyelets arranged along a slit which extends longitudinally along the palm of the glove. The gloves are tightly secured by pulling the laces tight and tying the ends of the laces together. Once properly secured, the user then maintains a fist with both hands within the gloves and begins their training routine which may include punching a heavy bag or sparring with a partner.

Throughout the routine, the hands of the user perspire. This perspiration is absorbed by the inner lining of the glove. As the routine continues the glove becomes uncomfortable as the inner lining becomes saturated with perspiration. Since the inner lining of the glove is enclosed, air cannot enter to dry the lining creating an unsanitary environment within the glove where bacteria reproduce. The bacteria within the glove can cause the inner lining to rot. With repeated use, the perspiration build up also causes odor problems within each glove.

The present invention provides boxing gloves which allow perspiration to escape, are easy to secure and encourage the hands to form a proper fist so that the potential for injury is reduced.

BRIEF SUMMARY OF THE INVENTION

A boxing glove formed by an inner mitt and a padded outside covering that utilizes breathable palm material, a full thumb retainer, a waterproof pad lining and grip bars.

The inner mitt is formed by the breathable palm material and the waterproof pad lining. The mitt is shaped so that when a hand is inserted all the fingers of the hand are contained within a finger compartment and the thumb of the hand is contained in a separate thumb compartment. The breathable palm material forms the front of the mitt and the pad lining forms the back of the mitt. The breathable palm material is formed by two layers, a thin breathable inner lining which contacts the palm and inner portion of the thumb and a breathable mesh outer material which forms the exposed outside palm of the glove. The inner lining wicks away perspiration from the hand of the user and the mesh outer material allows the perspiration to dry and escape to the outside. The waterproof pad lining is sewn to and opposes the breathable palm material forming the back of the mitt. When a hand is properly inserted into the mitt through the mouth of the glove the front of the mitt contacts the palm side of the hand and the back of the mitt contacts the back side of the hand.

A back of the mitt is padded by the attachment of the padded outside covering. The padded outside covering is formed by open or closed cell foam, cotton, wool or rubber padding which is covered by leather, vinyl, PVC or other durable material. The padded outside covering is sewn to the back of the mitt so that when a hand is inserted into the mitt and a fist is formed the outside surface of the fist is fully padded by the padded outside covering.

A collar is sewn to the mouth of the mitt. The collar secures the glove to the users hand using a strap which is attached at one end to the outside surface of the collar. The strap is wrapped in encircling relation around the collar so that the collar firmly engages the wrist of the user and is held in place by hook and loop fasteners. The inside surface of the collar and the palm of the mitt may contain a sizing slit which allows the collar to encircle many different size wrists for proper engagement.

In accordance with these and other objects which will become apparent hereinafter, the instant invention will now be described with particular reference to the accompanying drawings.

DETAILED DESCRIPTION OF THE INVENTION

Figure 1:
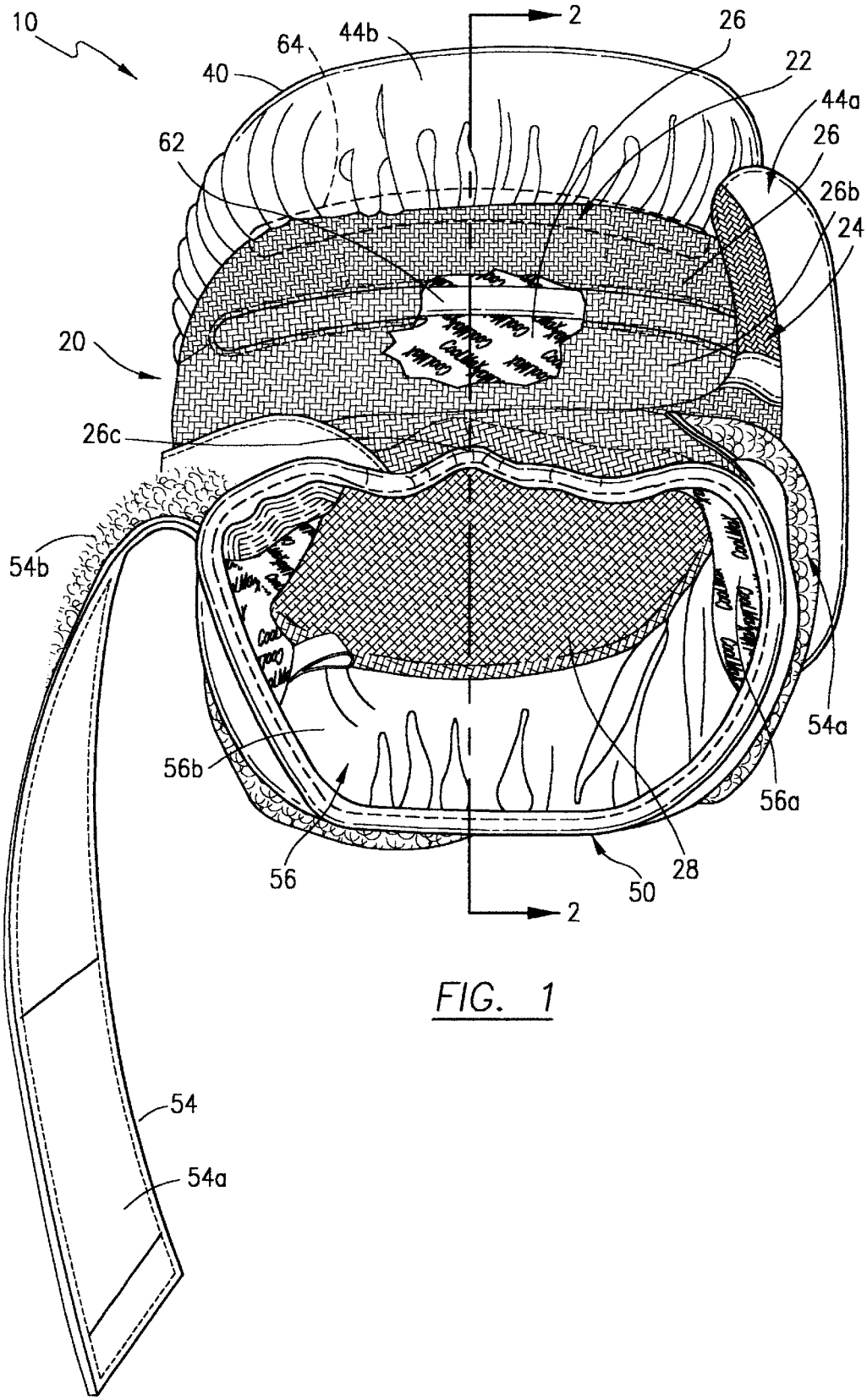
FIG. 1 is a perspective view of the boxing glove showing the palm of the glove.

Referring now to FIG. 1 there is shown boxing glove 10. The boxing glove 10 is formed by an inner mitt 20, a padded outside covering 40 and a collar 50 which is attached to the mouth of mitt 20.

Inner mitt 20 is shaped so that when a hand is inserted all the fingers of the hand are contained within finger compartment 22 and the thumb of the hand is contained in a separate thumb compartment 24. Mitt 20 is formed by a breathable palm lining 26 which opposes a waterproof pad lining 28.

Palm lining 26 forms the front of mitt 20 and pad lining 28 forms the back of mitt 20.

Figure 2:
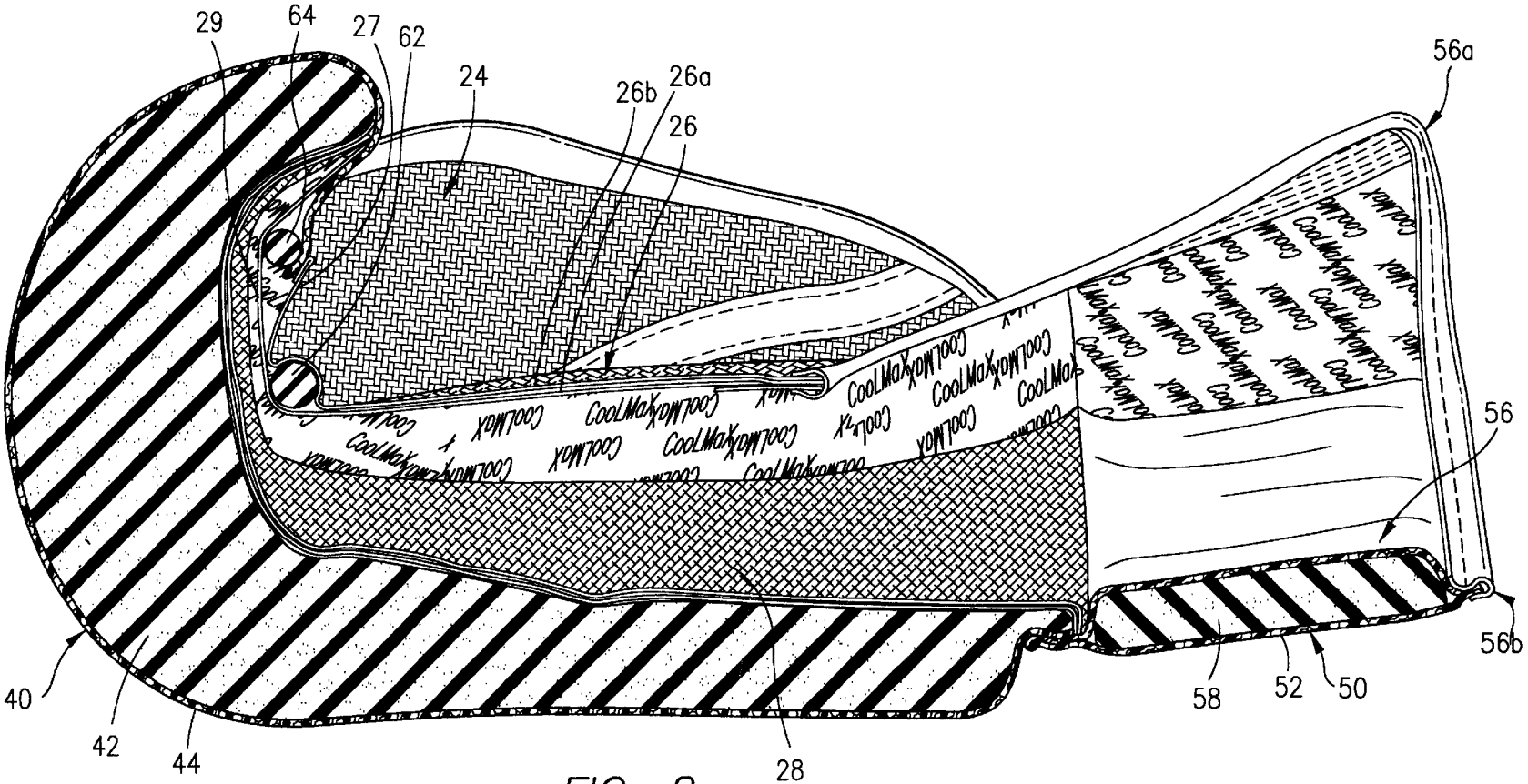
FIG. 2 is a sectional view of the boxing glove.

Referring now to FIG. 2, Palm lining 26 is formed by two layers, a thin breathable inner lining 26*a* which contacts the palm and inner portion of the thumb of the wearer and a mesh outer lining 26*b*. One side of outer lining 26*b* contacts inner lining 26*a* and the other side forms the outside palm of glove 10. Inner lining 26*a* is constructed from COOLMAX or other suitable breathable material and acts to absorb and wick away perspiration from the hand of the wearer. Outer lining 26*b* is constructed of breathable mesh material and forms the exposed outside palm of glove 10. Mesh outer lining 26*b* allows the perspiration wicked away by inner lining 26*a* to dry and escape to the outside. Palm lining 26 may be constructed with a leather thumb arc 27 which reinforces the thumb area and a padded reinforced outside palm area 29. Padded reinforced outside thumb area may be constructed of leather, vinyl, PVC or other suitable flexible material. The perimeter of palm lining 26 opposes and is sewn to pad lining 28 using conventional sewing methods. Pad lining 28 forms the back of mitt 20. Pad lining 28 is formed by waterproof Taffeta fabric so that glove 10 is easy to clean and maintains its weight since sweat is not absorbed by the padding of glove 10. When a hand is properly inserted into mitt 20 the palm lining 26 of mitt 20 contacts the palm of the hand of the wearer and pad lining 28 of the mitt 20 contacts the back of the hand of the wearer.

Two cylindrical grip bars 62 and 64 are sewn between the inner and outer linings 26*a* and 26*b* of the palm lining 26 of mitt 20. Each grip bar 62 and 64 is formed by flexible cylindrical closed cell foam that is approximately 1.2 cm in diameter. Closed cell foam is used so that sweat is not absorbed by the grip bars causing the weight of the glove to change. Alternatively, grip bars 62 and 64 may be formed by open cell foam, pvc, plastic or other suitable material. First grip bar 62 is positioned within palm lining 26 of mitt 20 so that it corresponds with the position of the proximal interphalangeal joints of the fingers of an average sized hand of a wearer. Second grip bar 64 is positioned within palm lining 26 of mitt 20 so that it corresponds with the position of the distal interphalangeal joints of the fingers of an average sized hand of a wearer. First and second grip bars 62 and 64 are adapted in length so that they extend across palm lining 26 of mitt 20. First and second grip bars 62 and 64 encourage proper fist formation by causing the fingers of the wearer to curl around both first and second grip bars 62 and 64. The positioning of first and second grip bars 62 and 64 provide reference points which can be used to verify proper insertion of the hand.

A back of mitt 20 is padded by the attachment of padded outside covering 40. Padded outside covering 40 is formed by pad 42 which is covered by a cover 44. Pad 42 is constructed from closed cell foam and cover 44 is constructed from leather. Cover 44 may be made from vinyl, PVC, PU or other suitable flexible durable material. Pad 42 may be constructed from open cell foam, cotton, wool or rubber depending on the application. For instance, open cell foam may be used in training gloves to achieve a lighter weight. Padding 42 may also be covered by vinyl, PVC or other durable material. The perimeter of padded outside covering 40 is sewn to mitt 20 using conventional sewing methods so that the back of mitt 20 is covered. Padded outside covering 40 is curved so that a preshaped boxing glove 10 is formed. When a hand is inserted into mitt 20 the formation of a fist is encouraged by the shape of glove 10. Padding 42 is shaped so that when a fist is formed the entire outside surface of the fist is fully padded.

Figure 3:
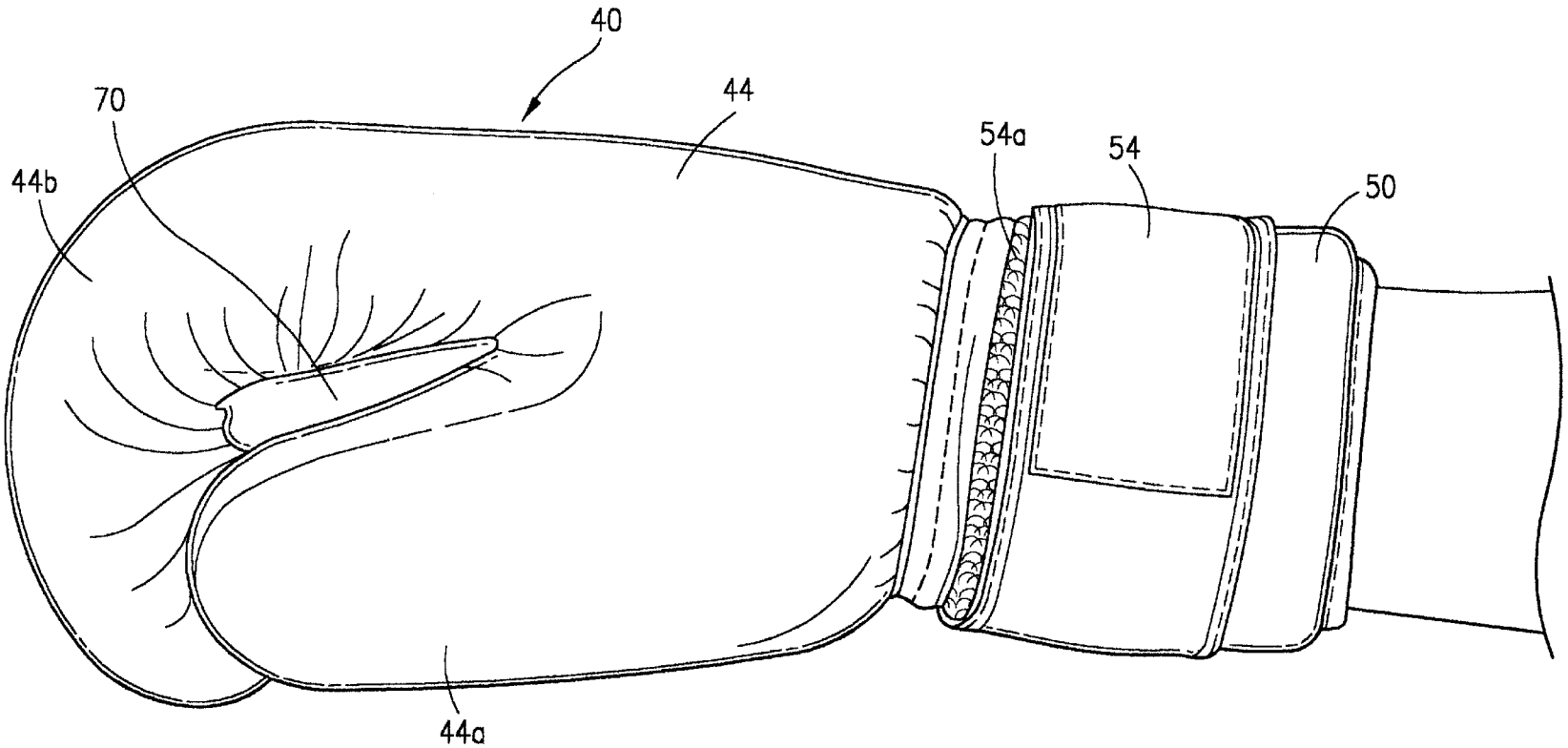
FIG. 3 is a perspective view of the boxing glove showing top of the glove and illustrating the thumb retainer.

Referring to FIG. 3, a thumb retainer 70 is attached to and joins the thumb 44*a* and finger 44*b* of the outside covering 44. Thumb retainer 70 is attached to thumb 44*a* and finger 44*b* by conventional sewing methods. By joining thumb 44*a* and finger 44*b* of outside covering 44, thumb 44*a* is prevented from extending and causing possible injury. Thumb retainer 70 is formed by leather and is sized so that thumb 44*a* of outside covering 44 is retained within 1–2 cm from finger 44*b* of the outside covering 44. Thumb retainer 70 can be sized so that thumb 44*a* is retained within a selected distance from finger 44*b*.

A padded cuff 50 is sewn to the mouth of mitt 20 and padded outside cover 40. Cuff 50 is formed by an outside leather cuff wrap 52 which is padded by closed cell foam cuff pad 58. Cuff wrap 52 may be constructed from vinyl, PVC or other suitable flexible material. Cuff 50 is divided into a front 56*a* and back 56*b*. Front 56*a* is attached to palm lining 26 and back 56*b* is attached to pad lining 28 and padded outside cover 40. The inside of front 56*a* is padded by cuff pad 58 and is lined by palm lining 26 which extends into cuff 50. The inside of back 56*b* is padded by cuff pad 58 and is lined by pad lining 28 which extends into cuff 50. Cuff 50 opens at the wrist where it meets palm lining 26 as seen in FIG. 1. Palm lining 26 may contain a sizing slit 26*c* which allows cuff 50 to be spread open so that a wearer may more easily insert their hand. Cuff 50 secures glove 10 to the wearers hand using a strap 54 which is attached at one end to the outside 56 of cuff 50. Strap 54 is wrapped in encircling relation around the outside 56 of cuff 50 so that cuff 50 firmly engages the wrist of the wearer and is held in place by cooperating hook and loop fasteners 54*a* and 54*b* located along the outside 50*b* of cuff 50 and the inside of strap 54 respectively. Cooperating hook and loop fasteners 54*a* and 54*b* are attached to the outside 50*b* of cuff 50 and the inside of strap 54 using conventional sewing methods. Strap 54 is formed by vinyl and is adapted in length so that it may wrap fully around cuff 50 when the hand of a wearer is properly inserted into glove 10 as seen in FIG. 3. Alternatively, collar 50 may be secured by tying laces which are threaded through eyelets located along slit 26*c* of palm lining 26 and the opening of collar 50.

In accordance with these and other objects which will become apparent hereinafter, the instant invention will now be described with particular reference to the accompanying drawings.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A boxing glove comprising:

an inner mitt configured to receive a human hand and separately enclose the respective fingers and thumb of said human hand, said inner mitt having a front, a back, and a mouth, said inner mitt having a means for allowing said hand to breath and for removing perspiration from the palm of the glove, said inner mitt having a means for preventing said glove from absorbing perspiration, said inner mitt having a means for encouraging proper fist formation;

a padded outside covering formed by a foam pad and a cover, said padded outside covering having a finger, thumb and hand areas, said padded outside covering attached to the back of said inner mitt, said padded outside covering having a thumb retaining means;

a padded cuff attached to the mouth of said inner mitt and said padded outside covering, said cuff adapted to receive the wrist of said hand, said cuff having a means for firmly engaging said wrist.

2. The boxing glove of claim 1 wherein said means for allowing said hand to breath is a two layer palm lining which forms said front of said mitt, said two layer palm lining constructed from a first layer which contacts the hand of a wearer and a second layer which contacts said first layer and forms the outside palm of said glove, said first layer constructed from high-performance wicking fiber material and said second layer constructed from perforated mesh material, whereby perspiration is removed from the glove through the mesh material.

3. The boxing glove of claim 2 wherein said means for preventing said glove from absorbing perspiration is a waterproof pad lining which forms said back of said inner mitt, said pad lining constructed from waterproof Taffeta.

4. The boxing glove of claim 3 wherein said means for encouraging proper fist formation are two grip bars sewn within said palm lining, said grip bars positioned so that they traverse the proximal and distal interphalageal joints of said fingers, said grip bars constructed from flexible cylindrical foam.

5. The boxing glove of claim 4 wherein said thumb retaining means is a thumb retainer, said thumb retainer attached to said thumb area of said padded outside covering and said finger area of said padded covering, said thumb retainer limiting the extension of said thumb area by its attachment to said finger area.

6. The boxing glove of claim 5 wherein said means for firmly engaging said wrist is a strap, said strap attached at one end to said cuff, said strap adapted to wrap in encircling relation around said cuff so that said cuff firmly engages said wrist, said strap secured around said cuff by cooperating hook and loop fasteners attached to said strap and said cuff.

7. The boxing glove of claim 6 wherein said cover is formed by leather.

8. The boxing glove of claim 6 wherein said cover is formed by Vinyl.

9. The boxing glove of claim 6 wherein said cover is formed by PVC.

10. The boxing glove of claim 5 wherein said means for firmly engaging said wrist are laces, said laces threaded through eyelets along said cuff.

11. A boxing glove comprising:

an inner mitt configured to receive a human hand and separately enclose the respective fingers and thumb of said human hand, said inner mitt having a front, a back, and a mouth;

said front formed by a two layer palm lining which allows said hand to breath, said two layer palm lining constructed from a first layer which contacts the hand of a wearer and a second layer which contacts said first layer and forms the outside palm of said glove, said first layer constructed from high-performance wicking fiber material and said second layer constructed from perforated mesh material, whereby perspiration is removed from the glove through the mesh material;

said back constructed from waterproof Taffetta preventing said glove from absorbing perspiration, said inner mitt having two grip bars sewn within said palm lining encouraging proper fist formation, said grip bars positioned so that they traverse the proximal and distal interphalageal joints of said fingers;

a padded outside covering formed by a foam pad and a cover, said padded outside covering having finger, thumb and hand areas, said padded outside covering attached to the back of said inner mitt, said padded outside covering having a thumb retainer attached to said thumb area and finger area of said padded outside covering which retains said thumb area, said thumb retainer limiting the extension of said thumb area by its attachment to said finger area;

a padded cuff attached to the mouth of said inner mitt and said padded outside covering, said cuff adapted to receive the wrist of said hand, said cuff having a strap, said strap attached at one end to said cuff, said strap adapted to wrap in encircling relation around said cuff so that said cuff firmly engages said wrist holding said glove in firm engagement with said hand, said strap secured around said cuff by cooperating hook and loop fasteners attached to said strap and said cuff.

* * * * *